US009314705B2

(12) United States Patent
Payne et al.

(10) Patent No.: US 9,314,705 B2
(45) **Date of Patent: *Apr. 19, 2016**

(54) TOY TRACK SET

(75) Inventors: Julian R. Payne, Los Angeles, CA (US); Alec Tam, Laguna Niguel, CA (US)

(73) Assignee: MATTEL, INC., El Segundo, CA (US)

( * ) Notice: Subject to any disclaimer, the term of this patent is extended or adjusted under 35 U.S.C. 154(b) by 405 days.

This patent is subject to a terminal disclaimer.

(21) Appl. No.: 13/220,097

(22) Filed: Aug. 29, 2011

(65) Prior Publication Data

US 2012/0061484 A1 Mar. 15, 2012

Related U.S. Application Data

(60) Provisional application No. 61/418,618, filed on Dec. 1, 2010, provisional application No. 61/391,349, filed on Oct. 8, 2010, provisional application No. 61/377,731, filed on Aug. 27, 2010, provisional application No. 61/377,766, filed on Aug. 27, 2010.

(51) Int. Cl.
*A63H 18/02* (2006.01)
*A63H 18/10* (2006.01)

(52) U.S. Cl.
CPC ..... *A63H 18/10* (2013.01); *A63H 18/028* (2013.01)

(58) Field of Classification Search
CPC ..... A63H 18/02; A63H 18/00
USPC ..... 446/444
See application file for complete search history.

(56) References Cited

U.S. PATENT DOCUMENTS

| | | | |
|---|---|---|---|
| 867,506 | A | 10/1907 | Hermann |
| 1,511,983 | A | 10/1924 | Shea |
| 1,545,676 | A | 7/1925 | Mantley |
| 1,551,002 | A | 8/1925 | Beck |
| 1,599,982 | A | 9/1926 | Bauer |
| 1,997,512 | A | 4/1935 | Einfalt |
| 2,746,206 | A | 5/1956 | Hammond, Jr. |
| 2,756,687 | A | 7/1956 | Fields |
| 3,281,985 | A | 11/1966 | Einfalt |
| 3,451,161 | A | 6/1969 | Lemelson |

(Continued)

FOREIGN PATENT DOCUMENTS

| | | |
|---|---|---|
| EP | 0525657 A1 | 2/1993 |
| GB | 2029246 A | 3/1980 |

(Continued)

OTHER PUBLICATIONS

International Search Report for International Application No. PCT/US2011/049581; Date of Mailing: Apr. 27, 2012.

(Continued)

*Primary Examiner* — Michael Dennis
(74) *Attorney, Agent, or Firm* — Cantor Colburn LLP

(57) ABSTRACT

A toy track set includes a vehicle path defined by a track and a gap disposed between a first gap end and a second gap end. The toy track also includes a carriage assembly configured to carry a toy vehicle across the gap such that the toy vehicle travels from the first gap end to the second gap end on the carriage assembly, the carriage assembly being moved from the first gap end to the second gap end by an assembly having an arm rotatable about an axis of rotation and that rotates through an angle equal to or greater than 360 degrees as it carries the toy vehicle from the first gap end to the second gap end.

16 Claims, 16 Drawing Sheets

(56) References Cited

U.S. PATENT DOCUMENTS

| | | | | |
|---|---|---|---|---|
| 3,494,070 | A | 2/1970 | Lemelson | |
| 3,540,153 | A | 11/1970 | Aoki | |
| 3,600,849 | A * | 8/1971 | Faller | A63H 18/14 446/429 |
| 3,613,306 | A | 10/1971 | Arai | |
| 3,626,635 | A | 12/1971 | Birdsall | |
| 3,633,308 | A | 1/1972 | Yang | |
| 3,690,393 | A | 9/1972 | Guy | |
| 3,693,290 | A | 9/1972 | Breslow et al. | |
| 3,721,036 | A | 3/1973 | Goldfarb | |
| 3,858,875 | A | 1/1975 | Nemeth et al. | |
| 3,860,238 | A | 1/1975 | Kojima | |
| 3,955,429 | A | 5/1976 | Holden | |
| 4,031,661 | A | 6/1977 | Bernhard | |
| 4,045,908 | A | 9/1977 | Ensmann et al. | |
| 4,051,624 | A | 10/1977 | Ogawa | |
| 4,068,402 | A | 1/1978 | Tanaka | |
| 4,128,964 | A | 12/1978 | Ogasawara | |
| 4,221,076 | A | 9/1980 | Ozawa | |
| 4,222,195 | A | 9/1980 | Kurosawa et al. | |
| 4,237,648 | A | 12/1980 | Moe et al. | |
| 4,249,733 | A | 2/1981 | Eddins et al. | |
| 4,254,576 | A | 3/1981 | Matsumoto et al. | |
| 4,306,375 | A | 12/1981 | Goldfarb et al. | |
| 4,312,149 | A | 1/1982 | Iwao | |
| 4,357,778 | A | 11/1982 | Matsumoto et al. | |
| 4,386,777 | A | 6/1983 | Prehodka | |
| 4,394,961 | A | 7/1983 | Muller | |
| 4,429,488 | A | 2/1984 | Wessels | |
| 4,438,590 | A | 3/1984 | Lee | |
| 4,443,967 | A | 4/1984 | Jones et al. | |
| 4,475,305 | A | 10/1984 | Kawakami et al. | |
| 4,492,058 | A | 1/1985 | Goldfarb et al. | |
| 4,496,330 | A | 1/1985 | Terui | |
| 4,547,174 | A | 10/1985 | Lee et al. | |
| RE32,106 | E | 4/1986 | Lemelson | |
| 4,609,363 | A | 9/1986 | Udagawa | |
| 4,678,449 | A | 7/1987 | Udagawa | |
| 4,708,685 | A | 11/1987 | Udagawa | |
| 4,767,376 | A | 8/1988 | Hanzawa | |
| 4,940,444 | A | 7/1990 | Russell | |
| 4,990,117 | A | 2/1991 | Yonezawa | |
| 5,038,685 | A | 8/1991 | Yoneda et al. | |
| 5,279,871 | A | 1/1994 | Segan et al. | |
| 5,342,048 | A | 8/1994 | Jones et al. | |
| 5,441,435 | A | 8/1995 | Shiraishi | |
| 5,452,893 | A | 9/1995 | Faulk et al. | |
| 5,678,489 | A | 10/1997 | Wang | |
| 5,785,573 | A | 7/1998 | Rothbarth et al. | |
| 5,855,501 | A | 1/1999 | Kato et al. | |
| 5,890,945 | A | 4/1999 | Asami et al. | |
| 5,899,789 | A | 5/1999 | Rehkemper et al. | |
| 5,931,714 | A | 8/1999 | Johnson | |
| 5,951,357 | A | 9/1999 | Mandle et al. | |
| 6,083,078 | A | 7/2000 | Yang | |
| 6,173,654 | B1 | 1/2001 | Ngai | |
| 6,241,573 | B1 | 6/2001 | Ostendorff et al. | |
| 6,341,564 | B1 | 1/2002 | Ochi | |
| 6,358,112 | B1 | 3/2002 | Lambert et al. | |
| 6,422,151 | B2 | 7/2002 | Maleika | |
| 6,450,857 | B1 | 9/2002 | Watanabe | |
| 6,478,654 | B1 | 11/2002 | Rehkemper et al. | |
| 6,508,179 | B2 | 1/2003 | Annis et al. | |
| 6,676,480 | B2 | 1/2004 | Sheltman | |
| 7,285,034 | B2 | 10/2007 | Kay et al. | |
| 7,517,272 | B2 | 4/2009 | Bedford et al. | |
| 7,537,509 | B2 | 5/2009 | Payne et al. | |
| 7,549,906 | B2 | 6/2009 | Bedford et al. | |
| 7,614,931 | B2 | 11/2009 | Nuttall | |
| 7,628,673 | B2 | 12/2009 | Bedford et al. | |
| 7,722,427 | B2 | 5/2010 | Yamana | |
| 8,011,994 | B2 | 9/2011 | Fink et al. | |
| 2003/0224697 | A1 | 12/2003 | Sheltman et al. | |
| 2005/0287915 | A1 | 12/2005 | Sheltman et al. | |
| 2005/0287916 | A1 | 12/2005 | Sheltman et al. | |
| 2005/0287918 | A1 | 12/2005 | Sheltman et al. | |
| 2005/0287919 | A1 | 12/2005 | Sheltman et al. | |
| 2006/0128256 | A1 * | 6/2006 | Collins et al. | 446/73 |
| 2006/0286896 | A1 * | 12/2006 | Bedford et al. | 446/444 |
| 2006/0286897 | A1 * | 12/2006 | Bedford et al. | 446/444 |
| 2007/0197127 | A1 | 8/2007 | Ostendorff et al. | |
| 2007/0209543 | A1 | 9/2007 | Beaulieu et al. | |
| 2008/0020675 | A1 | 1/2008 | Ostendorff | |
| 2008/0064295 | A1 | 3/2008 | Abrams | |
| 2008/0070474 | A1 * | 3/2008 | Nuttall | 446/444 |
| 2008/0146115 | A1 | 6/2008 | Yamana | |
| 2008/0171491 | A1 | 7/2008 | Sheltman | |
| 2008/0248716 | A1 | 10/2008 | Shackelford et al. | |
| 2009/0075558 | A1 | 3/2009 | Ostendorff | |
| 2009/0130946 | A1 | 5/2009 | Fink et al. | |
| 2009/0241798 | A1 | 10/2009 | Ngai | |

FOREIGN PATENT DOCUMENTS

| | | | |
|---|---|---|---|
| GB | 2049446 | A | 12/1980 |
| GB | 2123704 | A | 2/1984 |
| GB | 2187649 | A | 9/1987 |
| GB | 2198655 | A | 6/1988 |
| JP | 2004-194920 | A | 7/2004 |
| JP | 2009-297473 | A | 12/2009 |
| WO | 99/49948 | | 10/1999 |
| WO | 01/58556 | A1 | 8/2001 |

OTHER PUBLICATIONS

Written Opinion for International Application No. PCT/US2011/049581; Date of Mailing: Apr. 27, 2012.

Written Opinion for International Application No. PCT/US2011/049583; Date of Mailing: Apr. 27, 2012.

International Search Report for International Application No. PCT/US2011/049583; Date of Mailing: Apr. 27, 2012.

* cited by examiner

TOY TRACK SET

CROSS REFERENCE TO RELATED APPLICATIONS

This application claims the benefit of the following U.S. Provisional Patent Application Ser. Nos. 61/377,731 and 61/377,766 each filed on Aug. 27, 2010; 61/391,349 filed on Oct. 8, 2010; and 61/418,618 filed on Dec. 1, 2010, the contents each of which are incorporated herein by reference thereto.

BACKGROUND

Various embodiments of the present invention are related to toys in particular, a track set for toy vehicles to travel on.

Toy vehicle track sets have been popular for many years and generally include one or more track sections arranged to form a path around which one or more toy vehicles can travel. Toy vehicles which may be used on such track sets may be either self-powered vehicles or may receive power from an external source.

Accordingly, it is desirable to provide toy track set with features that provide unique paths for the toy vehicles of the toy track to travel on.

It is further desirable to provide a toy track set having a guide piece configured to attach the track set to a wide variety of objects, thus allowing for increased utility and creativity when building the toy vehicle track set.

SUMMARY OF THE INVENTION

In one embodiment, a toy track set that includes a vehicle path defined by a track and a gap disposed between a first gap end and a second gap end is provided. The toy track set of this embodiment also includes a carriage assembly configured to carry a toy vehicle across the gap such that the toy vehicle travels from the first gap end to the second gap end on the carriage assembly, the carriage assembly being moved from the first gap end to the second gap end by an assembly having an arm rotatable about an axis of rotation. In this embodiment, the carriage assembly rotates through an angle equal to or greater than 360 degrees as it carries the toy vehicle from the first gap end to the second gap end.

In another embodiment, a toy track set that includes a vehicle path defined by a track and a gap disposed between a first gap end in a first vertical plane and a second gap end in a second vertical plane different than the first vertical plane is provided. The toy track set of this embodiment also includes a carriage assembly configured to carry a toy vehicle across the gap such that the toy vehicle travels from the first gap end to the second gap end on the carriage assembly. The carriage assembly of this embodiment being moved from the first gap end to the second gap end by an assembly having an arm rotatable about an axis of rotation and having a carrying assembly at or near is end that receives the toy vehicle.

In yet another embodiment, a toy track set includes a guide piece having multiple fasteners for attaching the track set to a variety of objects. The guide piece of this embodiment contains a receiving section, comprising sidewalls, for accepting the track set, wherein the receiving section is removably attached at any segment of track set. Furthermore, the receiving section is configured to attach to the track set without impeding the movement of a toy vehicle on the track set. The guide piece further incorporates fasteners to facilitate attachment of the guide piece to an object. Fasteners may be removable, permanent and/or combinations thereof, examples of fasteners include, but are not limited to, a suction cup, a zip tie, an anchor, a hook-and-loop, a strap, a clamp, a hook, a clasp, a clip, a retaining ring, and a rubber band. The guide piece preferably has two or more fasteners. The combined utility of the fastener and receiving section allows the guide piece to adapt the toy vehicle track set to suit the play arrangement desired by the end user, while configuring to the environment in which the track set is being utilized.

In a further embodiment of a toy track set, the guide piece is removably and slideably configured to attach to the toy vehicle track set, securing the track set to the guide piece. In another embodiment, the guide piece is removably and slideably configured to attach to the conclusion of the toy vehicle track set. In yet another embodiment, the guide piece is configured to attach two segments of track set to each other, while removably and slideably attaching to the toy vehicle track set.

In one embodiment of the a toy track set, the fastener is a suction cup, which functions to secure the guide piece to a flat surface such as, for example, a floor or a wall. In another embodiment, the fastener is a hook-and-loop for securing the guide piece to a textile (e.g. carpet, couch, drapes). In yet another embodiment, the fastener is a cable tie that may be used to secure the guide piece to an object that the track set may not be suited to attach to. For example, the fastener may be used to couple the guide piece to a doorknob. Of course, other configurations are possible. In one embodiment, the fastener is a gyratory hook, which functions to secure the guide piece to a protrusion or edge, for example, the arm of a chair.

DETAILED DESCRIPTION

Reference is made to the following U.S. Pat. Nos. 7,628,673 and 7,549,906 the contents each of which are incorporated herein by reference thereto.

Figure 1:
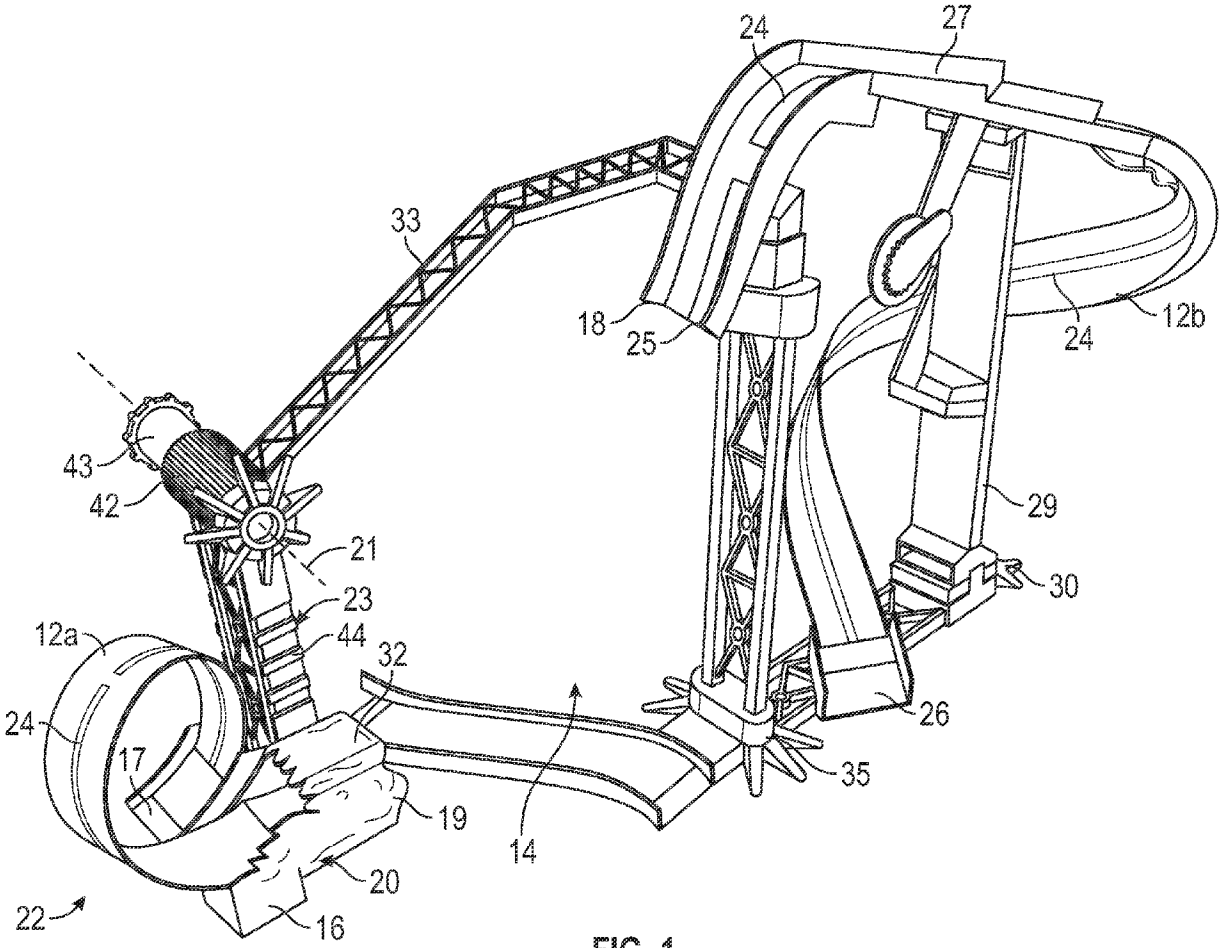
FIG. 1 is a perspective view of a toy track set in accordance with an exemplary embodiment of the present invention.

As illustrated in FIG. 1, one embodiment is directed to a toy track set 10. The toy track set 10 of this embodiment includes a vehicle path defined by a track 12 and a gap 14 disposed between a pair of gap ends 16, 18. Gap ends 16 and 18, respectively, define at least one end of a first track portion 12*a* and a second track portion 12*b*. It shall be understood that the toy track set 10 may include several other pieces not shown in FIG. 1. For example, the toy track set 10 may include one or all of the extension track 214 and the guide pieces 200 and 300 shown in FIGS. 6A and 6B.

The toy track set 10 shown in FIG. 1 further comprises a carriage assembly 20 configured to carry a toy vehicle across the gap 14 such that the toy vehicle may travel from one of the pair of ends of the gap to another one of the pair of ends of the gap (e.g. from gap end 16 to gap end 18 or vice versa). In one embodiment, the carriage assembly 20 starts at a first position where it contacts gap end 16 as shown in FIG. 1 and rotates to second position where it contacts gap end 18. In one embodiment, the carriage assembly 20 rotates about a rotational axis 21. In an exemplary embodiment, the carriage assembly 20 rotates more than 360 degrees around the rotational axis 21 as it moves from the first position to the second position. In one embodiment, the carriage assembly 20 rotates 540 degrees around the rotational axis 21 as it moves from the first position to the second position Gap end 18 is higher than gap end 16 in one embodiment and as illustrated in FIG. 1. Of course, the gaps ends 16, 18 could be at the same height in one embodiment or gap end 16 could be higher than gap end 18. Gap ends or ends 16 and 18 may be referred, respectively, as first gap 16 and second gap end 18.

Figure 2:
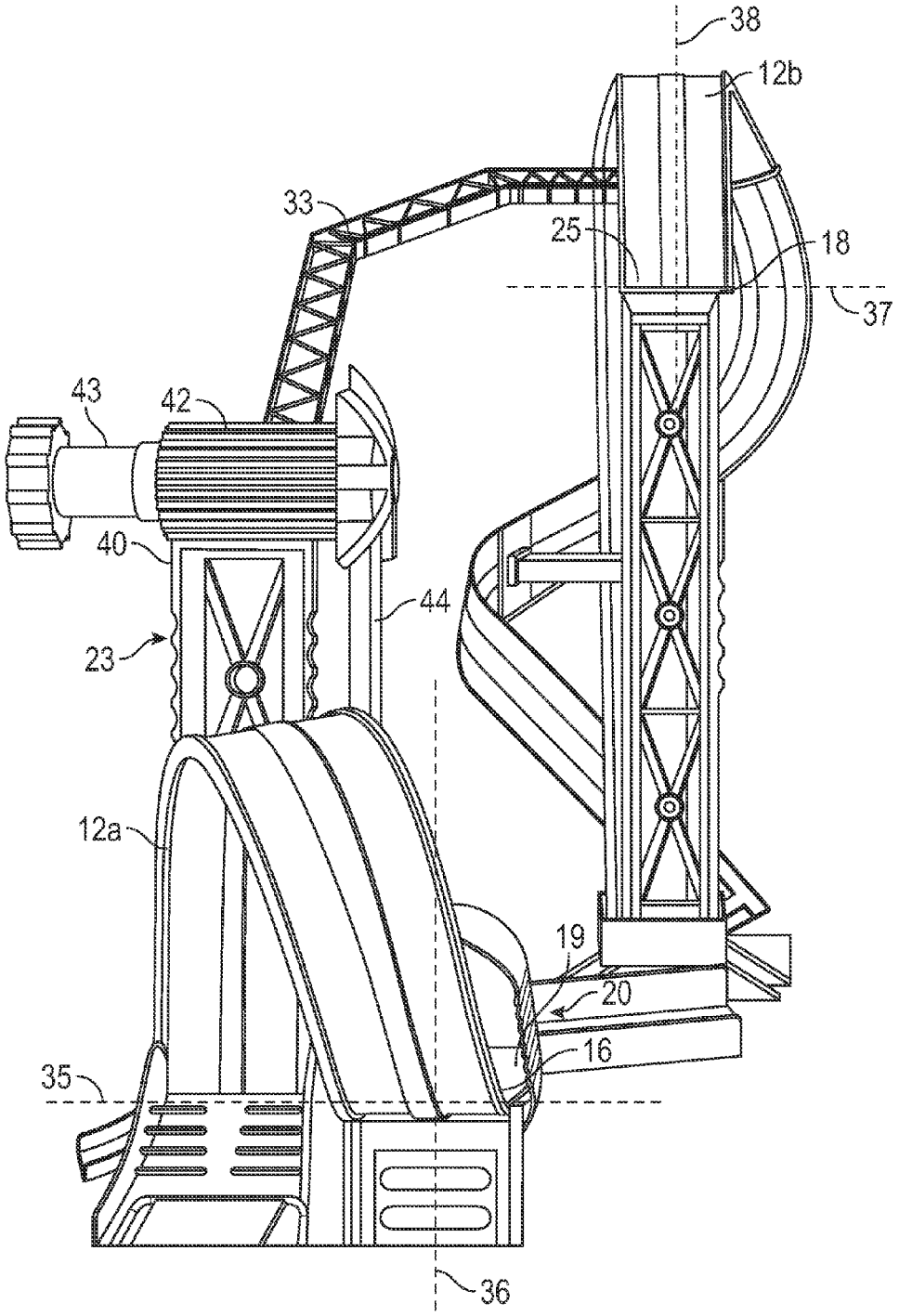
FIG. 2 is a different perspective view of the toy track set shown in FIG. 1 in accordance with an exemplary embodiment of the present invention.

In one embodiment, and as illustrated in most clearly in FIG. 2, the first gap end 16 is in a first horizontal plane 35 at a level defined by the level of the second end 19 of the first track portion 12*a*. Similarly, the second gap end 18 is, in one embodiment, in a second horizontal plane 37 at a level defined by the level of the first end 25 of the second track portion 12*b*. The first horizontal plane 35 is different than the second horizontal plane 37 in one embodiment and can be either above or below the second horizontal plane 37. In addition, the first gap end 16 is in a first vertical plane 36 and the second gap end 18 is in a second vertical plane 38. In one embodiment, the first vertical plane 36 is different than the second vertical plane 38 and the carriage assembly 20 translates the toy vehicle from the first vertical plane 36 to the second vertical plane 38, or vice versa. In one embodiment, the carriage assembly 20 rotates as it translates the toy vehicle from the first vertical plane 36 to the second vertical plane 38. In one embodiment, the carriage assembly 20 rotates through more than 360 degrees as it translates the toy vehicle from the first vertical plane 36 to the second vertical plane 38. In one embodiment, the carriage assembly 20 rotates through 540 degrees as it translates the toy vehicle from the first vertical plane 36 to the second vertical plane 38.

In one embodiment, the toy vehicle is self propelled. Motion or propulsion of the toy vehicle may be achieved through a variety of propulsion means. Such toy vehicle propulsion means can include storing energy for propulsion in the vehicle, drawing energy for propulsion from an external power source, or manually propelling the vehicle. Storing energy in a toy vehicle may occur by electrically or mechanically storing energy. For example, energy can be stored electrically by charging a battery on a toy vehicle or energy can be stored mechanically by spinning an inertial flywheel. One non-limiting example of a self propelled toy vehicle is illustrated in U.S. Pat. No. 6,450,857 the contents of which are incorporated herein by reference thereto. A toy vehicle may have different speeds and may change speeds selectively while moving on a toy play set.

In FIG. 1, the track 12 is laid out in a particular configuration. It shall be understood that the particular configuration shown is not limiting. In the non-limiting example, the first track portion 12*a* includes a first end 17 and a second end 19 shown as being at the same location as gap end 16. The first track section 12*a* includes a loop 22 between the first end 17 and the second end 19. Of course, such a loop is not required. In the non-limiting example of FIG. 1, the second track portion 12*b* includes a first end 25 shown as being at the same location as gap end 18 and a second end 26.

In the illustrated embodiment, the second track portion 12*b* includes an optional diverter stage 27. The diverter stage 27 is coupled to a third track portion 29 that includes a third track end 30. The diverter stage 27 is configured to divert a toy vehicle traversing the second track portion 12*b* off of track portion 12*b* onto third track portion 29 before the toy vehicle reaches the second end 26 of the second track portion 12*b*. The diverter stage 27 can divert the toy vehicle based on a user selection or randomly.

In one embodiment, a toy vehicle is provided with locomotion and provided to the first end 17 of the first track portion 12*a*. The toy vehicle traverses the first track portion 12 until it reaches the first gap end 16. The toy vehicle then enters or otherwise engages a housing 32 of the carriage assembly 20. The housing 32 includes means for holding the toy vehicle within it in one embodiment. When the toy vehicle engages the housing 32, the carriage assembly 20 moves the toy vehicle from the first gap end 16 to the second gap end 18. In one embodiment, the toy vehicle then traverses the second track portion 12*b* and exits the toy track set 10 at the second end 26 of the second track portion 12*b*. In the event that the toy track set 10 includes diverter stage 27, the toy vehicle may be diverted off of the second track portion 12*b* before and reaches the second end 26 thereof. In such a case, the toy vehicle exits the toy track set 10 at the third track end 30 of the third track portion 29.

It should be understood that the toy vehicle may traverse the toy track set 10 in the opposite direction as just described. In such a case, the toy vehicle enters the toy track set 10 at either third track end 30 or the second end 26 of the second track portion 12*b*. The toy vehicle then engages the housing 32 of the carriage assembly 20 at gap end 18. When the toy vehicle engages the housing 32, the carriage assembly 20 moves the toy vehicle from the second gap end 18 to the first gap end 16. In one embodiment, toy vehicle then traverses the first track portion 12*a* and exits the toy track set 10 at the first end 17 of the first track portion 12*a*.

In one embodiment, a ferromagnetic material 24 is disposed in the track 12 (and optional third track portion 30) and the toy vehicle has at least one magnet disposed therein. The ferromagnetic material 24 and the magnet in the toy vehicle are attracted to each other and hold the toy vehicle in contact with the track 12 such that the toy vehicle may travel on the track 12 (or third track portion 30) in any orientation. For example, the toy vehicle may traverse the track 12 in a horizontal, inverted or vertical fashion or any combinations thereof.

The toy track set 10 may include an optional spacer mechanism shown as arm 33 in FIGS. 1 and 2 that holds the first gap end 16 in a fixed relationship to the second gap end 18. As illustrated, this may be accomplished by connecting the assembly 23 to a support beam 29 that supports the second track portion 12*b*.

In FIG. 2, the carriage assembly 20 is shown as being rotationally secured to a base 40 that supports a rotational housing 42. The rotational housing 42 surrounds and supports rotation shaft 43. Rotational shaft 43 turns within the rotational housing 42 and imparts circular motion to arm 44, which in turn imparts movement to the carriage assembly 20. The carriage assembly 20 and housing 32 are coupled to the arm 44 at or near its end.

Figure 3:
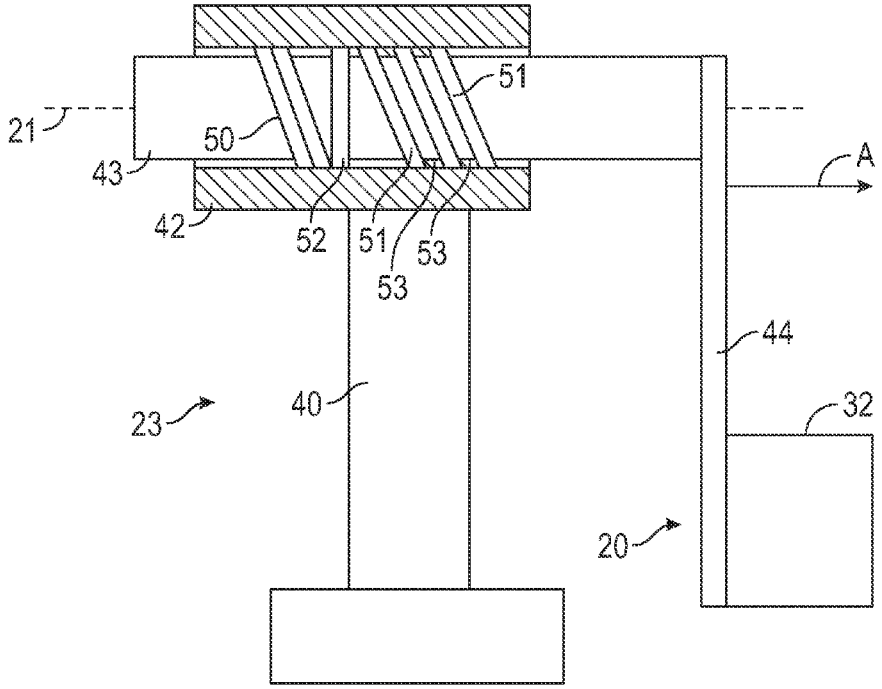
FIG. 3 is partial cross sectional view of a mechanism for use with an exemplary embodiment of the present invention in a first position.

FIG. 3 shows a partial cross-sectional side-view of an assembly 23 for imparting movement to the carriage assembly 20 according to one embodiment. The assembly 23 of this embodiment includes base 40 that supports rotational housing 42. In FIG. 3, rotational housing 42 is show in cross-section. The rotational housing 42 surrounds and supports rotational shaft 43. In one embodiment, rotational shaft 43 includes threads 51 that engage with corresponding threads 53 internal to rotational housing 52. Threads 51 and 53 may, thereby, form a worm gear and thus as shaft 43 is rotated, the carriage assembly 20 moves axially along the axis of rotation as well as rotationally about the axis of rotation. In the illustrated embodiment, a tensioning mechanism or spring 50 is disposed within the rotational housing 42 and applies mechanical pressure to a pressure receiving ring 52 that may be part of the rotational shaft 43. In other words, spring 50 is configured to provide a biasing force in the direction of arrow A when compressed due to rotation of shaft 43 and associated carriage in a first or clockwise direction.

The mechanical pressure or biasing force imparted by the tensioning mechanism or spring 50 causes the rotational shaft 43 to move in the direction shown by arrow A when the spring is compressed due to rotation of shaft 43 and associated carriage 20 in a first or clockwise direction and thus shaft 43 and associated carriage 20 move in a second or counter clockwise direction when the biasing force of the spring is released. As the rotational shaft 43 moves in the direction of arrow A, the worm gear configuration of threads 51 and 53 cause the rotational shaft 43 to rotate about axis 21. In this manner, the carriage assembly 20 and housing 32 are moved from a first orientation in a first vertical plane 36 to a second orientation in a second, different vertical plane 38. In one embodiment, tensioning mechanism 50 is a spring.

For example and when the carriage assembly 20 is located at the second position proximate to the second gap end 18 and portions of assembly 23 including carriage assembly 20 are rotated in a first clockwise direction, shaft 43, arm 44 and carriage assembly 20 are moved in a direction opposite to arrow A such that the carriage assembly 20 can be located at the first position proximate to the first gap end 16 and spring 50 is now compressed such that a biasing force is provided in the direction of arrow A. Once carriage assembly 20 is at this first position it engages a portion of the track at the first gap end 16 in order to retain the carriage assembly thereto and receive the toy vehicle therein. Once the toy vehicle is received within the carriage assembly 20 the toy vehicle will actuate a release mechanism that disengages the carriage assembly 20 from the track proximate to the first gap end 16 and release the biasing force of the spring 50. Accordingly, the biasing force of spring 50 will cause the carriage assembly 20 rotate as well as translate in the direction of arrow A such that the carriage assembly is now at the second position corresponding to the second gap end 18 and the toy vehicle can now travel from the carriage assembly 20 onto the track proximate to the second end 18.

Figure 4:
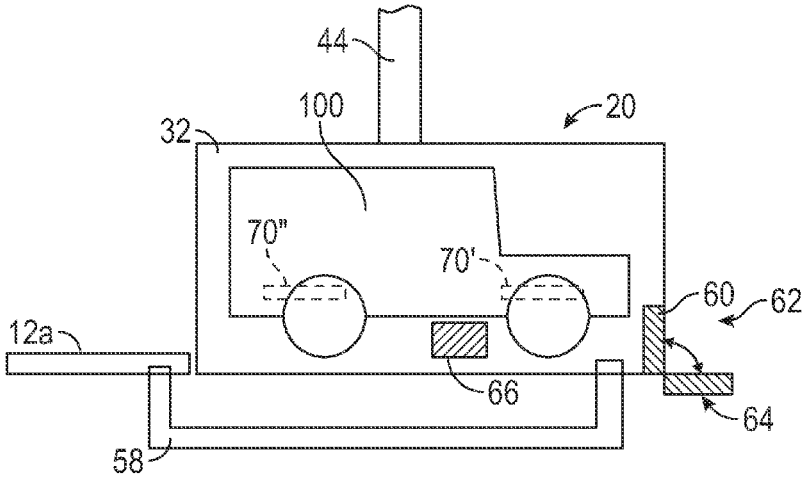
FIG. 4 is a side view of a portion of a carriage mechanism for use with an exemplary embodiment of the present invention.

As illustrated in FIG. 4, the housing 32 further comprises a release mechanism 58 positioned on the housing 32 of the carriage assembly 20. The release mechanism 58 is configured to engage the first gap end 16 when the release mechanism 58 is in a first position and thus retain spring 50 in its compressed state such that the biasing force of the spring 50 is in the direction of arrow A. As shown, the release mechanism 58 is engaged with the first track portion 12*a* (e.g., engaging first gap end 16). When the toy vehicle 100 enters the housing 32 (or is sufficiently within it such that the housing 32 can translate the toy vehicle 100 without dropping it) the release mechanism 58 releases its engagement with the first track portion 12*a*. When released, the housing 32 translates the toy vehicle to the second position defined by second gap end 18 due to the biasing force of spring 50 causing the rotation of shaft 43, arm 44 and carriage assembly 20.

Optionally, the release mechanism 58 may engage the second track portion 12*b*. As described above, a tensioning mechanism 50 (FIG. 3) may provide the energy to translate the toy vehicle from the first portion to the second position. In one embodiment, a user must wind the arm 44 back until the release mechanism 58 again engages the first track portion 12*a* to return the housing 32 to the first position.

The release mechanism 58 of the housing 32 may also include movable barrier 60 that is moved from a first position 62 to a second position 64 when the release mechanism 58 engages the second track portion 12*b*. At other times the movable barrier 60 is in the first portion 64. As such, the movable barrier 60 ensures that the toy vehicle 100 is secured within the housing 32 in at least one direction.

In one illustrative and optional embodiment, in order to retain the toy vehicle 100 on the housing 32, a magnet 66 engages ferromagnetic material in the toy vehicle 100 or vice versa (i.e., magnet of the vehicle engages ferromagnetic material in the housing). Once the housing 32 is released, it begins to rotate toward the second position under the power of the tensioning mechanism 50 until it engages with the second track portion 12*b*. In such an embodiment, the release mechanism may cause the magnet 66 to move away from the toy vehicle 100 and allow it roll or drive forward out of the housing 32. It shall be understood that magnet 66 may be utilized in combination with or instead of the movable barrier 60.

As described above with respect to FIG. 1, the toy track set 10 includes multiple points of ingress or egress. For example, a toy vehicle may enter the toy track set 10 at the first end 17 of the first track section 12*a*, the second end 26 of the second track section 12*b* or the third end 30 of the third track portion 29. Of course, additional track portions could be added to the track set 10 at any of these locations to increase the length of the track set 10.

Figure 5:
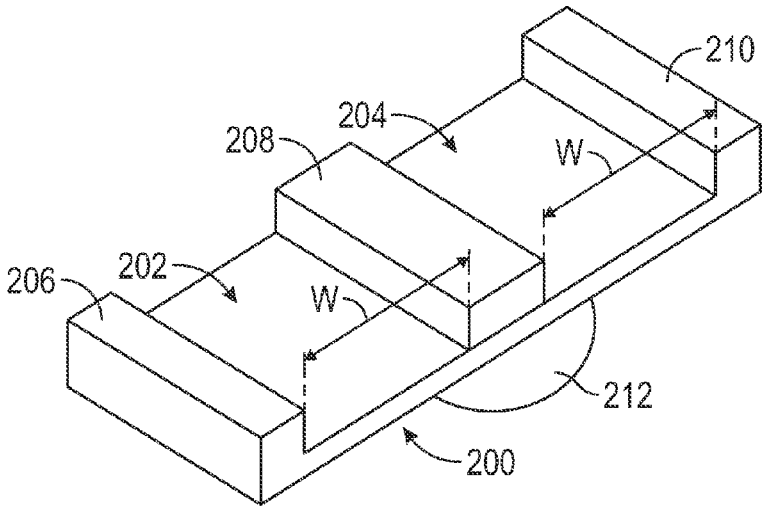
FIG. 5 is a perspective view of a guide piece that may utilized with in an exemplary embodiment of the present invention.

In one embodiment, the additional track may be attached to a guide piece 200, an example of which is shown in a perspective view in FIG. 5. Also, the guide piece 200 may be attached to any of the track sections whether they are additional track portions or track portions of a track set. Furthermore, the guide piece maybe slid or relocated anywhere along the track sections such that the configuration or securement point of the track segment to a surface may be adjusted.

The guide piece 200 shown in FIG. 5 includes a first track portion receiving section 202 and a second track portion receiving section 204. The first track receiving portion 202 has a width w defined by sidewalls 206 and 208 and the second track portion 204 has a same width w defined by sidewalls 208 and 210 in the illustrated example. Of course, the guide piece 200 may have any number of track receiving portions and each of them may be of any width. In one embodiment, the guide piece 200 includes a fastening device 212. The fastening device 212 functions to secure the guide piece 200 to a flat surface such as, for example, a floor or a wall. In one embodiment, the fastening device 212 is a suction cup.

Figure 6A:
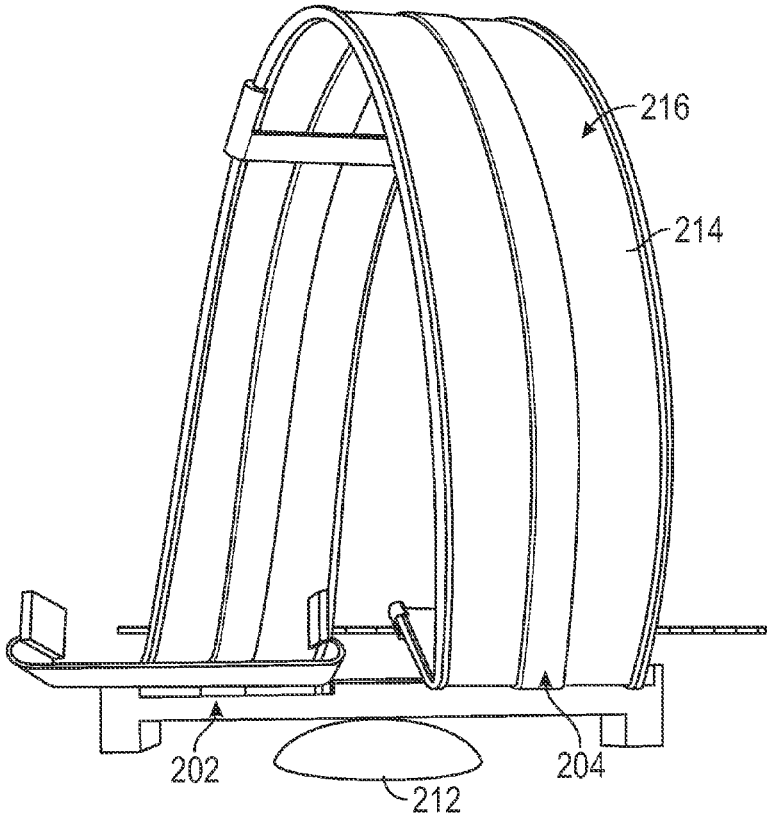
FIGS. 6A and 6B show different perspective views for one possible configuration of extension track arranged in a guide piece according to an exemplary embodiment of the present invention.
Figure 6B:
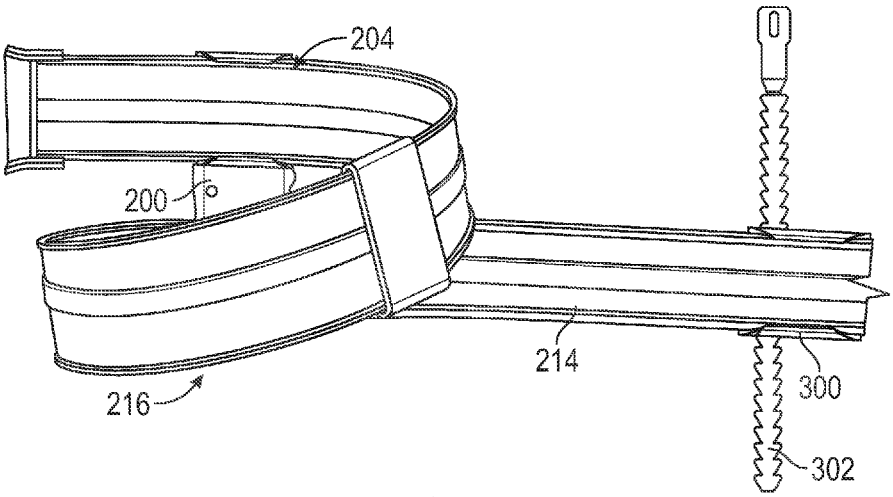

FIGS. 6A and 6B show different perspective views for one possible configuration of extension track 214 arranged in a guide piece 200 according to one embodiment. As illustrated in FIGS. 6A and 6B, the fastening device 212 is coupling the guide piece 200 to floor. Of course, the fastening device 212 could couple the guide piece 200 to another surface such as, for example a wall or a piece of furniture. In the illustrated embodiment, the extension track 214 is formed into a loop 216 by passing it through both the first track receiving portion 202 and the second track receiving portion 204. Of course, other configurations are possible. In one embodiment, the extension track 214 includes, similar to the other track portions, a ferromagnetic material 24 disposed therein to allow a toy vehicle to traverse the extension track 214 in an upright or upside-down orientation, among others.

As shown in particular in FIG. 6B, the extension track 214 may be coupled to a second fastener 302 by a second guide piece 300. In this example, the second fastener 302 is a cable tie that may be used to fasten the extension track 214 to an object that the guide piece 200 may not be suited to attach to. For example, the second fastener 302 may be used to couple the extension track 214 to a doorknob. It shall be understood that while guide pieces 200 and 300 as shown coupled to extension track 214 they could be coupled to any track portion disclosed herein. The first and second guide pieces 200, 300 and any other elements associated therewith may collectively or individually be referred to herein as toy track set accessory.

Various embodiments of a carriage assembly 20 for receiving and engaging the toy vehicle are illustrated in the following U.S. Provisional Patent Application Ser. Nos. 61/377,731 and 61/377,766 each filed on Aug. 27, 2010; 61/391,349 filed on Oct. 8, 2010; and 61/418,618 filed on Dec. 1, 2010, the contents each of which are incorporated herein by reference thereto.

Still further and referring now to FIGS. 7A-8C another embodiment of the carriage assembly 20 is illustrated. As mentioned above, the carriage or carriage assembly 20 further comprises a release mechanism 58 positioned on the carriage or carriage assembly 20 wherein, the release mechanism 58 is configured to engage one of the pair of ends 16 of the track when the release mechanism is in a first position and the release mechanism is configured to release the release mechanism from the one of the pair of ends 16 of the track when the release mechanism is moved to a second position from the first position. Accordingly, the release mechanism 58 allows the carriage 20 to releasably engage the ends of the track. During use of the track set, the release mechanism 58 is moved from the first position to the second position by the toy vehicle as it travels onto the carriage assembly 20 from the track.

When the release mechanism 58 is moved to the second position the carriage assembly 20 is now free to be rotated by assembly 23 such that the carriage assembly is moved from one of the pair of ends of the track 16 to the other one of the pair of ends of the track 18.

In one embodiment and in order to retain the vehicle on the carriage 20, a magnet 70 or magnets 70' and 70" of the vehicle engage a ferromagnetic material 72 disposed on the housing 32 of the carriage assembly 20 similar to the ferromagnetic material disposed in the track.

In order to releasably engage end 16 of the track 12, a releasable catch 74 is pivotally secured to the housing portion 32 of the carriage 20 through pin member 76 about an axis 78 such that pivotal movement of a first releasable catch 74 between a first position and a second position is possible. First releasable catch 74 has a first end portion 80 configured to releasably engage end 16 of the track 12 when the carriage 20 is abutted thereto and when the vehicle 22 is not on the carriage 20. In one embodiment first end portion 80 has a feature 81 configured to engage a feature of the track end 16. Release mechanism 58 also has a second releasable catch 75 that also has a second end portion 82 configured to contact end 18 of the track after the carriage 20 traverses gap 14.

In order to engage end 16 of the track 12 the releasable catch 74 is biased in the direction of arrow 84 by a spring 86 which causes feature 81 of end 80 to engage a portion or feature of end 16 of the track.

Once the carriage 20 is released by the vehicle 22 travelling thereon and the carriage 20 and the vehicle 22 traverses the gap 14 and arrives at end 18, the forward end 82 of the second releasable catch 75, which is configured to have a chamfered surface 87, engages an angled or chamfered surface of end 18 of the track. Once the chamfered surface 87 of the forward end 82 engages a surface proximate to the end 18 of the track, a blocking feature 90 is moved into the surface of the housing 32 so that the vehicle 100 can now travel from the carriage 20 onto the track 12 proximate to end 18 since vehicle 100 is self-propelled and was is in essence, being held in check by feature 90, which is no longer in a blocking position due to the contact of surface 87 with a surface proximate to the end 18 of the track. Thereafter, the vehicle 100 travels onto the track 12 proximate to end 18.

Accordingly, carriage 20 is configured to releasably engage end 16 of the track through an end 80 of a first releasable catch 74 of the release mechanism that is spring biased into a first or an engagement position. The pivotal securement of the releasable catch 74 allows it to move away from a feature proximate to end 16 and then the biasing force applied by the spring to the first releasable catch causes a feature 81 of end 80 to engage end 16 and secure the carriage 20 thereto. Once secured to end 16, carriage 20 is configured to receive a vehicle 100 from track 12. As vehicle 100 travels onto the carriage 20 from the track the vehicle 100 contacts a movable member or pair of movable members 94 movably or pivotally secured to the carriage 20 to move down into a surface of the carriage 20 in order to move the first releasable catch 74 from the first position to the second position as the vehicle travels onto the surface of the carriage 20 and thus releases the carriage form end 16 of the track. Thereafter, the carriage is moved to end 18 via rotational movement of arm 44 or any other equivalent structure.

The release mechanism 58 is configured such that the first releasable catch 74 is configured to have a pair of members 94 each being pivotally secured to the housing 32 and/or the first releasable catch such that movement of the pair of members 94 into the surface of the housing by the vehicle will cause the first releasable catch 74 to move from the first position to the second position and thus release the carriage from the end 16 of the track. In this embodiment, the pair of movable members 94 are deployed from the surface of the carriage 20 when feature 81 engages end 16 of the track and the first releasable catch is in the first position. Here the vehicle contacts the movable members 94 and this contact causes feature 81 to release the carriage from the track end 16. However, a second feature 90 further along on the surface of the carriage is coupled to surface 87 and is also in a deployed position such that this feature 90 prevents the vehicle from travelling off of the carriage until the carriage has arrived at the end 18 of the track. When the carriage 20 arrives at the end 18 of the track surface 87 of the second releasable catch 75 engages a surface of proximate to track end 18 and this feature 90 is moved into a stowed position and the vehicle 100 can now travel off of the carriage 20 onto the track. In still another embodiment, second releasable catch 75 is coupled to first releasable catch 74 such that when surface 87 engages a surface proximate to track end 18, both pairs of features 94 and 90 are moved into a stowed position and the vehicle can now travel off of the carriage onto the track.

Figure 7A:
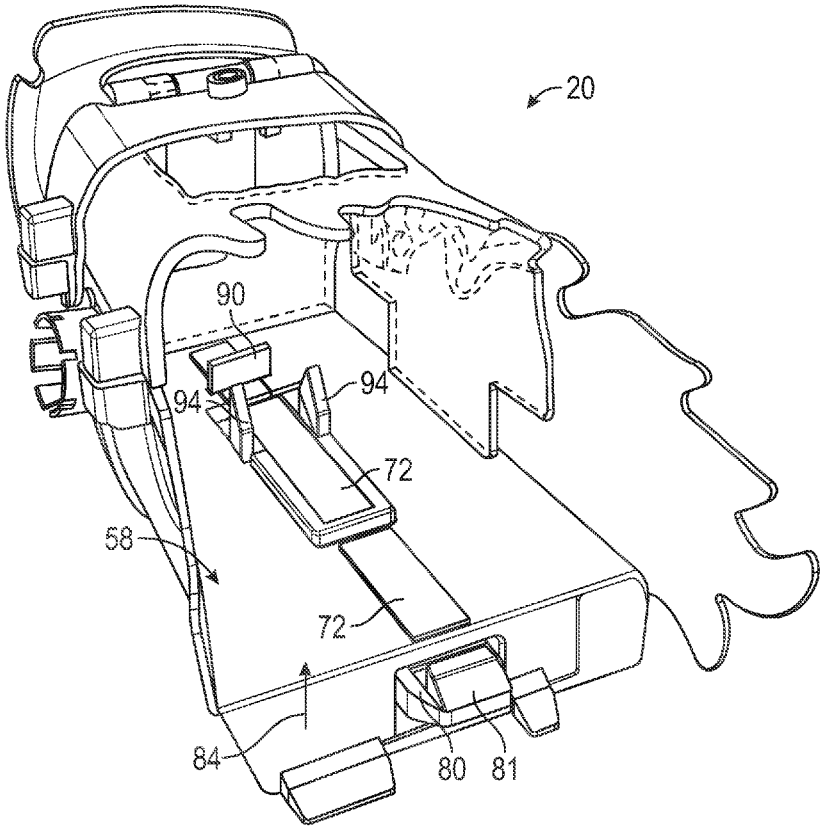
FIGS. 7A and 7B are perspective views of a carriage assembly according to one embodiment of the present invention.
Figure 7B:
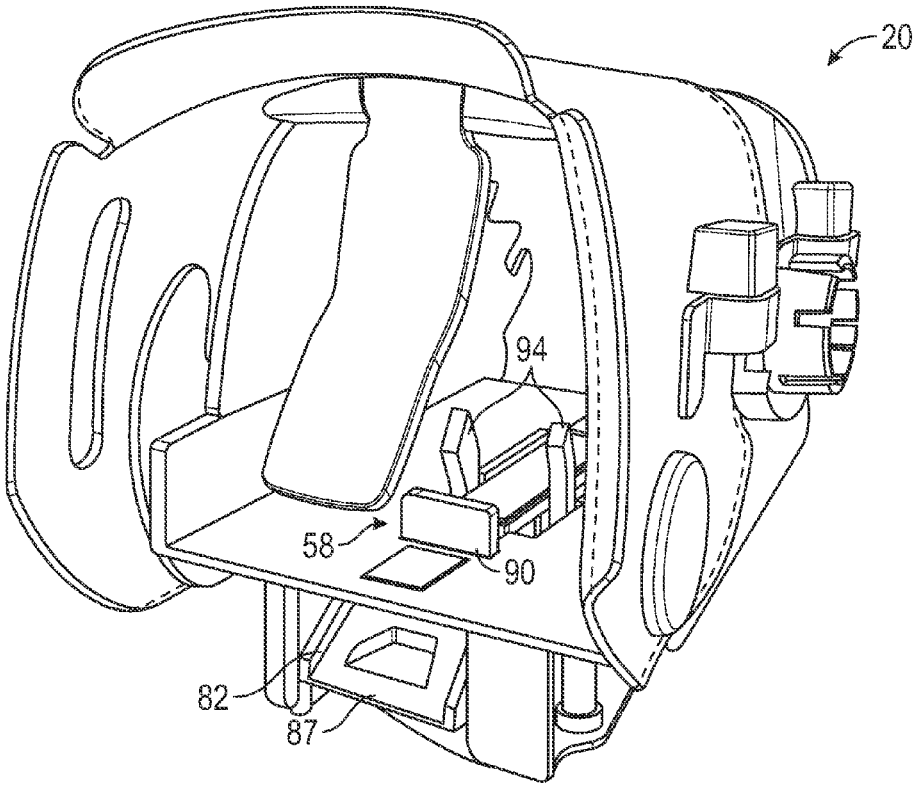
Figure 8A:
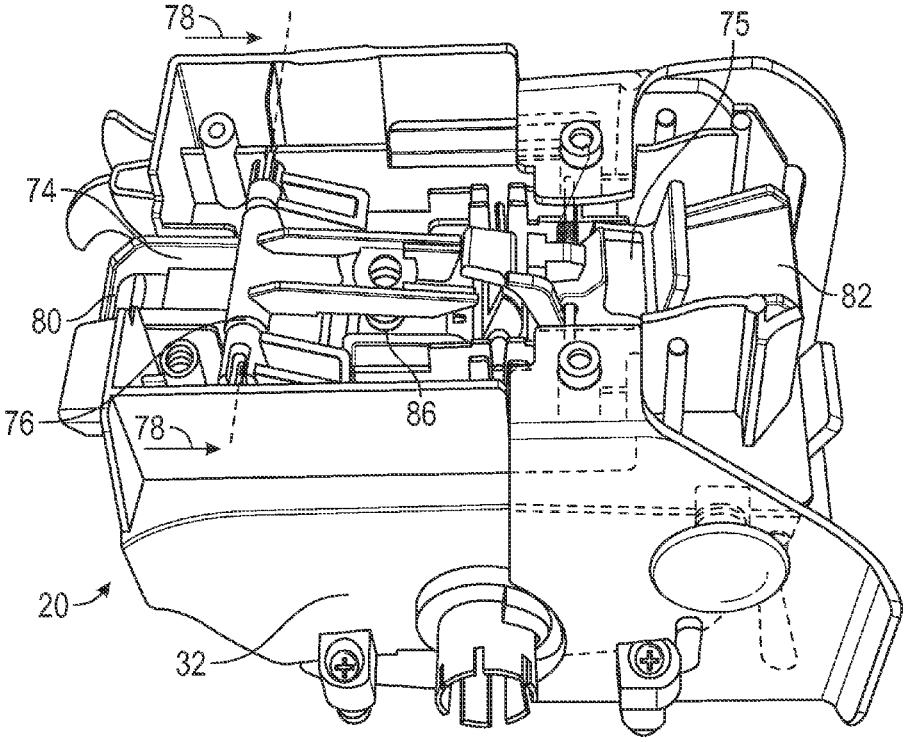
FIGS. 8A-8C illustrate a release mechanism of the carriage assembly illustrated in FIGS. 7A-7B, wherein a cover of the carriage assembly has been removed to illustrate the portions of the release mechanism.
Figure 8B:
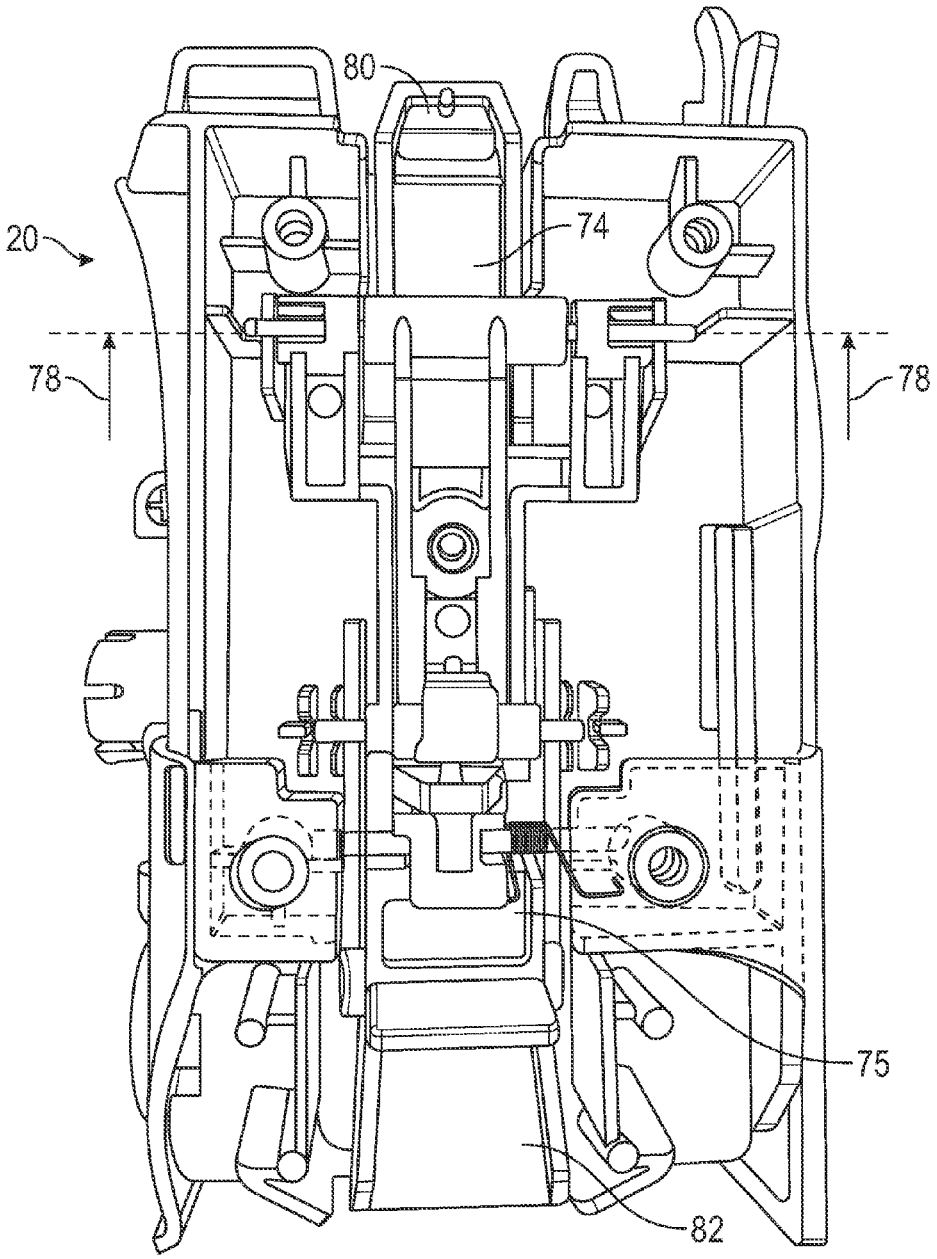
Figure 8C:
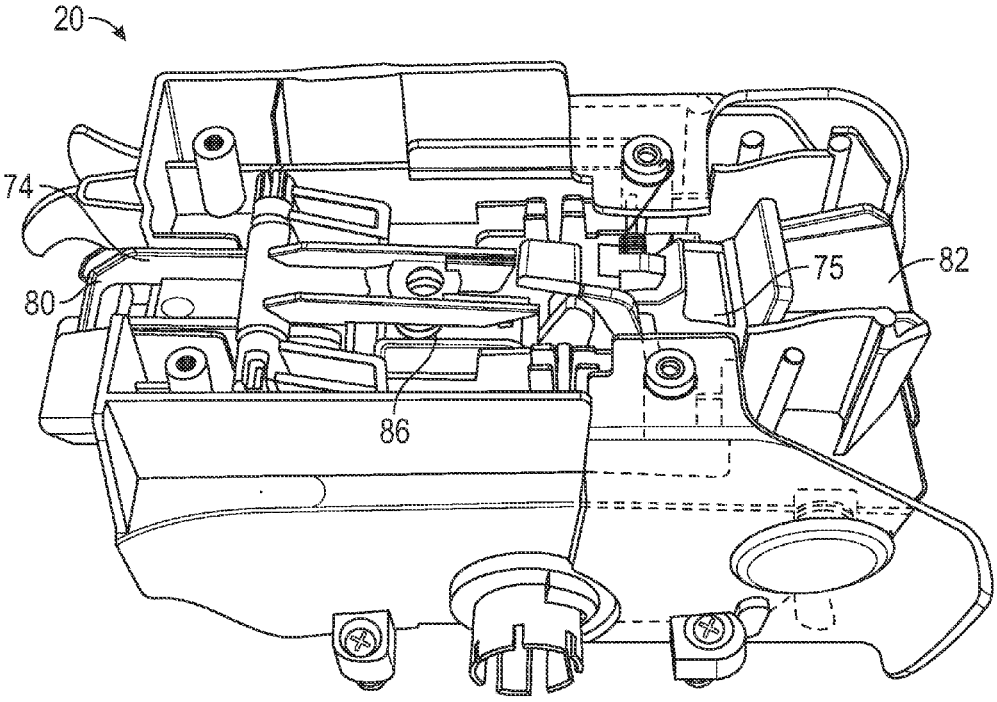

FIG. 7A illustrates an ingress end of the carriage assembly while FIG. 7B illustrates an egress end of the carriage assembly. Also illustrated is that the carriage assembly 20 in accordance with one non-limiting embodiment, has a canopy or shroud 91 and a portion of the shroud at the egress end is formed by a flexible material 93 which can deflect or compress when the carriage 20 contacts end 18 so that there is no jarring or damage to the carriage when it contacts end 18. In addition and in one non-limiting embodiment, there is a tab member 95 pivotally mounted to the shroud such that it is spring biased into the position illustrated in the FIGS. and the tab member pivots out of the way or out from the egress end as the vehicle travels 100 away from the carriage assembly 20. Tab member 95 also prevents the vehicle from being dislodged from the carriage assembly when it contacts end 18.

Figure 9A:
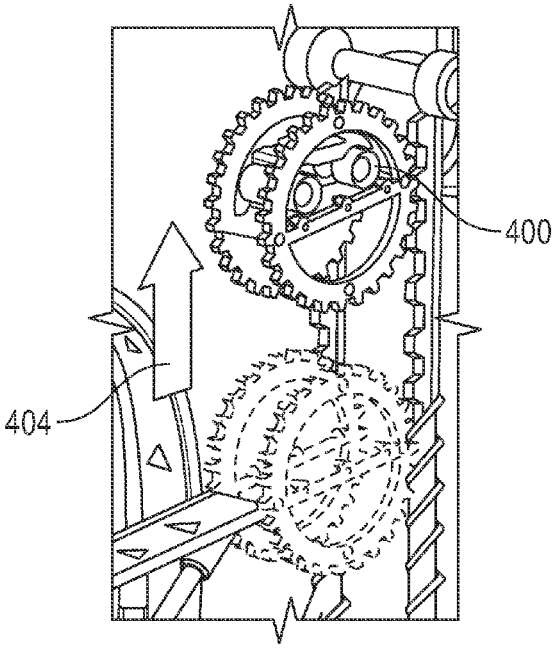
FIGS. 9-11 illustrate alternative embodiments of the present invention.
Figure 9B:
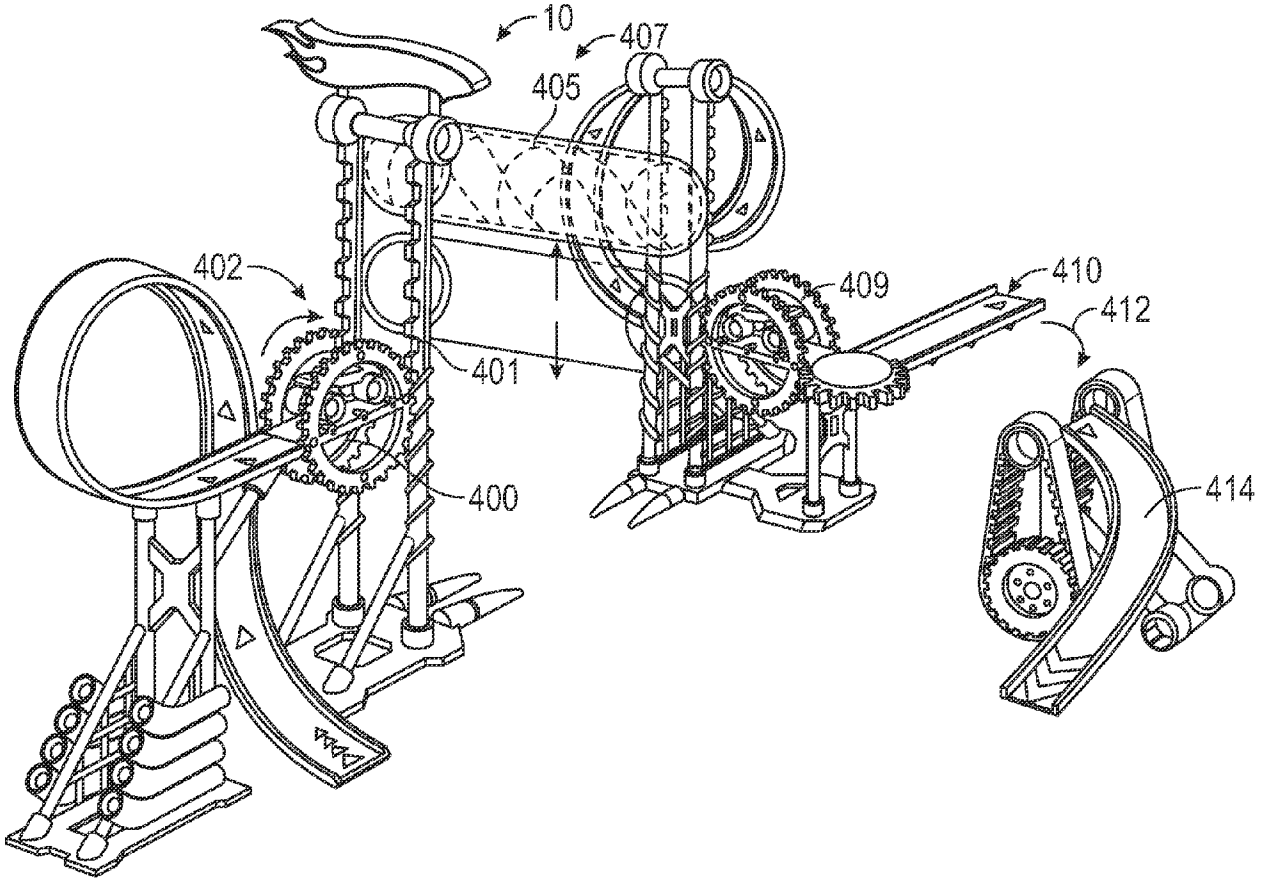
Figure 10:
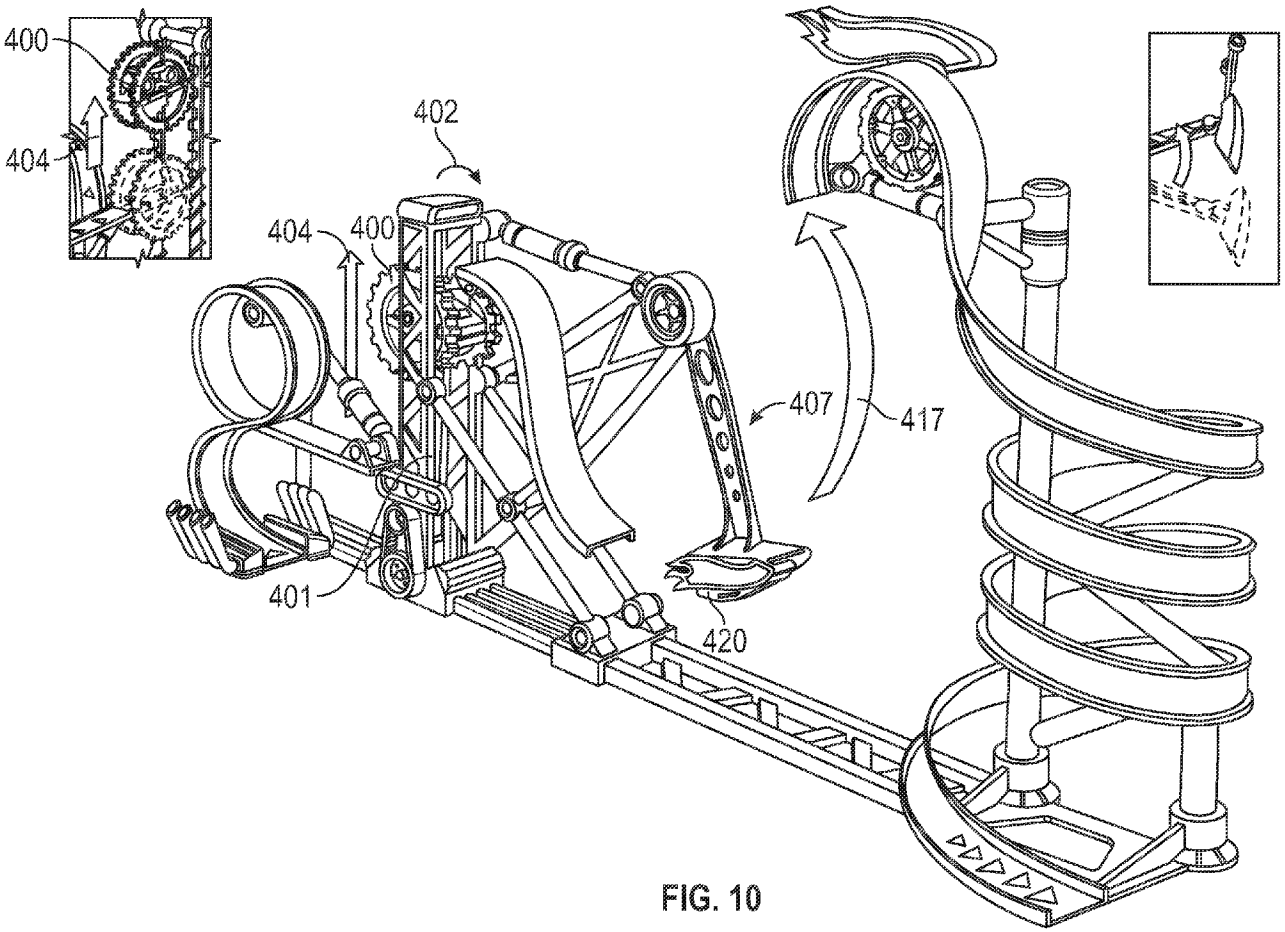
Figure 11:
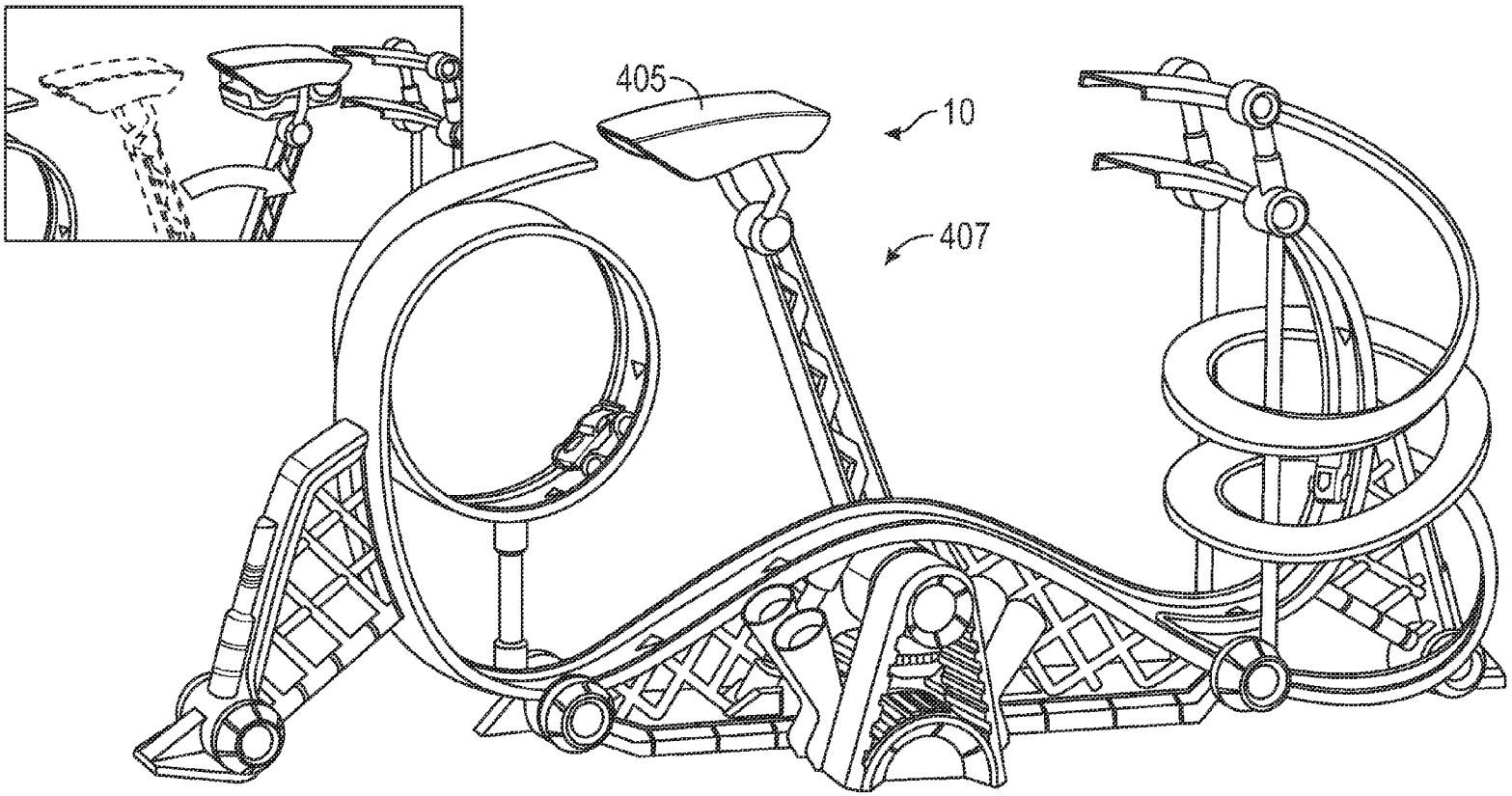
Figure 12:
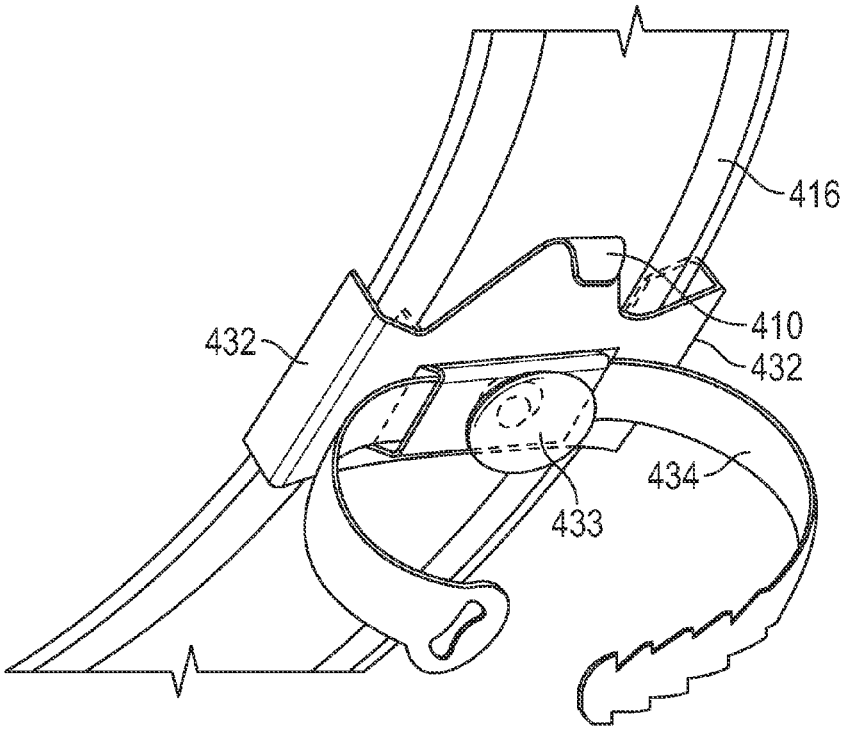
FIGS. 12-15 illustrate embodiments of the guide piece incorporating various and/or multiple fasteners.

FIGS. 9-11 illustrate alternative embodiments of the present invention, wherein various alternative configurations of the track set are illustrated. In FIGS. 9 and 10, the track set further comprises an elevator device 400 that is rotationally mounted on a tower 401 for movement up and down in the tower. In one embodiment, rotational movement of the elevator device 400 in one direction will cause the elevator device 400 to move up the tower 401 while opposite movement will cause it to move down the tower 401.

The elevator device 400 is configured to receive the toy vehicle from a track segment. Once received therein, the self propelled vehicle will impart a rotational force to the elevator such that it rotates in the direction of arrow 402 and moves upward the direction of arrow 404 until it stops at a higher portion on the tower and the vehicle is then allowed to travel from the elevator device onto another device 405 that allows the vehicle to traverse a gap 407 between two track segments. In an alternative embodiment, the elevator may be self propelled to move in the direction of arrow 404. Also illustrated in FIG. 9 another device 409 that is provided to receive the toy vehicle therein. Once the self propelled toy vehicle is received in device 409 movement of the same will cause a movable arm to rotate in the direction of 412 such that the toy vehicle may travel from the device 409 to another track segment 414.

FIG. 10 illustrates another track set 10 wherein a carriage device 420 is mounted to an arm that pivots in the direction of arrow 417 in order to carry the toy vehicle across the gap.

Figure 13:
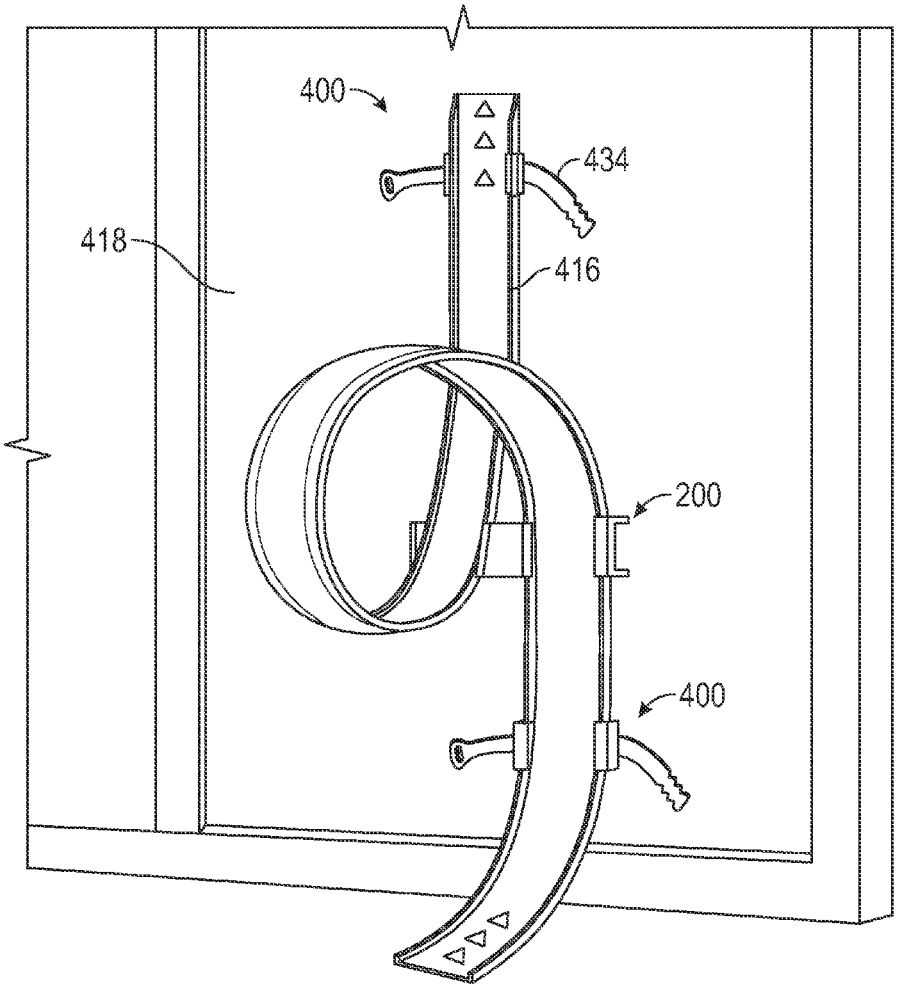

With reference to FIGS. 13-16, various embodiments of the guide piece have been illustrated incorporating one or more fasteners. In FIG. 13, the extension track 416 is coupled to the guide piece 400, and loosely retained thereabouts by sidewalls 432. The guide piece 400 may comprise anyone of multiple fasteners for attaching the guide piece to various objects. By way of example, FIG. 13 depicts three fasteners, including a suction cup 433, hook 410, and strap 434. Other fasteners may include a zip tie, an anchor, a hook-and-loop, a clamp, a clasp, a clip, a retaining ring, or a rubber band. Accordingly, guide piece 400 may have any combination of the aforementioned fasteners or simply just one of the aforementioned fasteners. The sidewalls 432 depicted in FIG. 13 exhibit the slideable feature of the guide piece 400, allowing for greater utility in configuring the track set to the environment in which it is being utilized.

Figure 14:
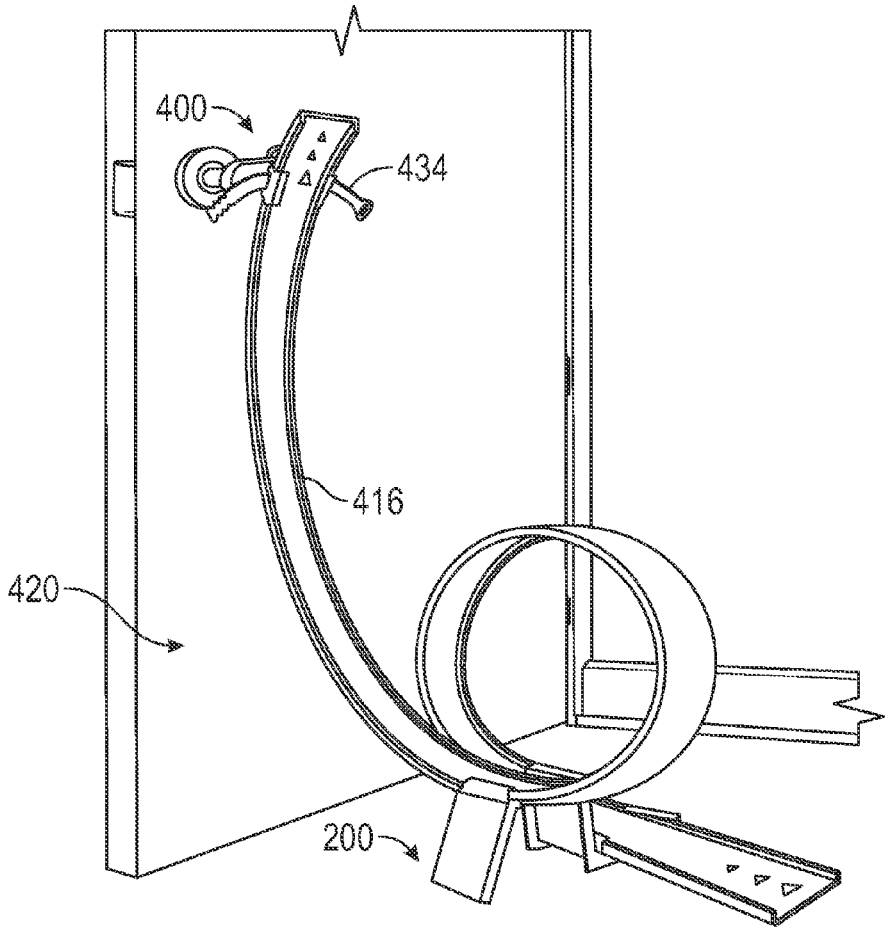
Figure 15:
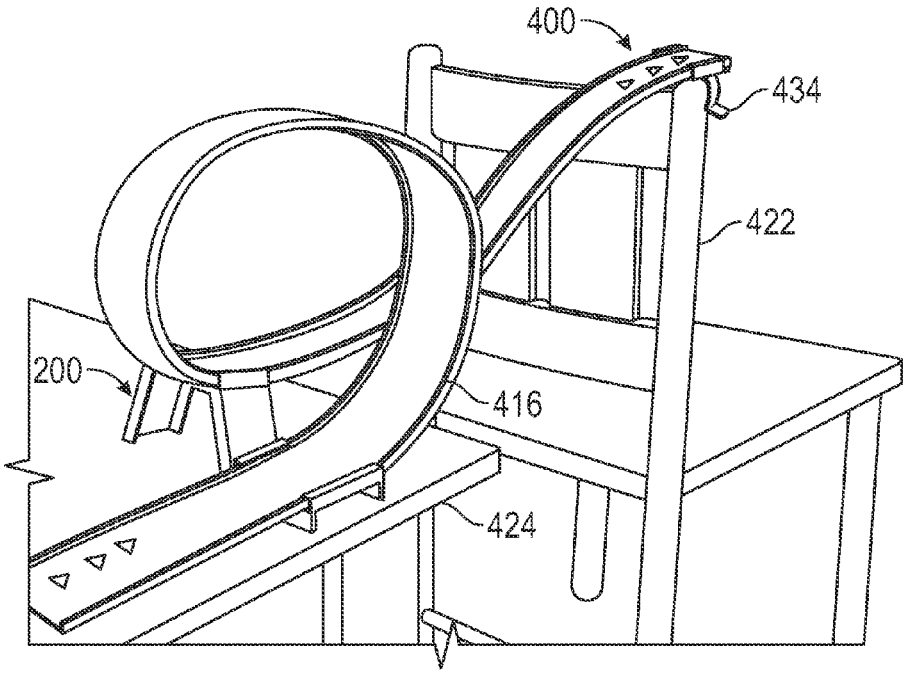

FIGS. 14-16 depict amenable use of the guide piece 400 in accordance with one or more embodiments of the present invention. FIG. 14 depicts the guide piece 400 adapted for attaching the toy vehicle track set to a wall 418. The fastener incorporated may be a suction cup 433 or hook 410, or a combination thereof. FIG. 15 depicts the guide piece 400 adapted for attaching the toy vehicle track set to a door 420 by using the strap 434. As depicted in FIG. 15, multiple guide pieces 200, 400 may be used to establish the desired track set configuration. FIG. 16 depicts the guide piece 400 adapted for attaching the toy vehicle track set from a chair 422 to a table 424. Once again the use of various and/or multiple fasteners may be incorporated to build the desired track set configuration.

In the preceding detailed description, numerous specific details are set forth in order to provide a thorough understanding of various embodiments of the present invention. However, those skilled in the art will understand that embodiments of the present invention may be practiced without these specific details, that the present invention is not limited to the depicted embodiments, and that the present invention may be practiced in a variety of alternative embodiments. Moreover, repeated usage of the phrase "in an embodiment" does not necessarily refer to the same embodiment, although it may. Lastly, the terms "comprising," "including," "having," and the like, as used in the present application, are intended to be synonymous unless otherwise indicated. This written description uses examples to disclose the invention, including the best mode, and to enable any person skilled in the art to practice the invention, including making and using any devices or systems. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A toy track set, comprising:

a vehicle path defined by a track and a gap disposed between a first gap end and a second gap end; and a carriage assembly configured to carry a toy vehicle across the gap such that the toy vehicle travels from the first gap end to the second gap end on the carriage assembly, the carriage assembly being moved from the first gap end to the second gap end by an assembly having an arm rotatable about an axis of rotation, wherein the carriage assembly rotates through an angle equal to or greater than 360 degrees as it carries the toy vehicle from the first gap end to the second gap end, wherein the carriage assembly includes a release mechanism, the release mechanism having a catch pivotally secured to the carriage assembly through a pin member about an axis wherein the release member being configured to engage the first gap end when the release mechanism is in a first position and release the release mechanism from the first gap end when the release mechanism is moved to a second position by the toy vehicle traveling onto the carriage assembly.

2. The toy track set of claim 1, wherein the vehicle path includes a first track portion including a first end and the first gap end and a second track portion including the second gap end and a second end and wherein the toy vehicle travels from the first end to the first gap end and from the second gap end to the second end.

3. The toy track set of claim 1, wherein the vehicle path includes a first track portion including a first end and the first gap end and a second track portion including the second gap end and a second end, the toy track further comprising:

a diverter stage displaced between the second gap end and the second end, the diverter connecting the second track portion to a third track portion having a third end;

wherein the toy vehicle travels from the first end to the first gap end and from the second gap end to the third end when the diverter is in a first position and from the first end to the first gap end and from the second gap end to the second end when the diverter is in a third position.

4. The toy track set of claim 1, further comprising:

a ferromagnetic material disposed in the track configured to magnetically engage a magnet disposed in the toy vehicle such that the toy vehicle may travel on the track in anyone of an inverted or vertical fashion.

5. The toy track set as in claim 1, wherein the carriage assembly includes a ferromagnetic material positioned to magnetically engage a magnet disposed in the toy vehicle such that the toy vehicle is coupled to the carriage assembly when the release mechanism is in the second position.

6. The toy track set as in claim 1, wherein the release mechanism is configured to engage the second gap end when the release mechanism is in a third position.

7. The toy track set as in claim 6, wherein the carriage assembly includes a ferromagnetic material positioned to magnetically engage a magnet disposed in the toy vehicle such that the toy vehicle is coupled to the carriage assembly when the release mechanism is in the second position and also configured to release the toy vehicle when the mechanism is in the third position.

8. The toy track set of claim 1, wherein the assembly includes:

a base;

a rotational housing supported by the base;

a rotational shaft surrounded by the rotational housing, rotatable about the axis of rotation and coupled to the rotatable arm, the rotational shaft engaging the rotational housing to form a worm gear.

9. The toy track set claim 8, wherein the assembly further includes:

a tensioning mechanism biasing the rotational shaft in a first direction, said biasing causing the rotational shaft to rotate within the rotational housing and thereby causing the carriage assembly to carry a toy vehicle across the gap from the first gap end to the second gap end.

10. The toy track set of claim 1, wherein the carriage assembly rotates through an angle of about 540 degrees as it carries the toy vehicle from the first gap end to the second gap end.

11. A toy track set, comprising:

a vehicle path defined by a track and a gap disposed between a first gap end in a first vertical plane and a second gap end in a second vertical plane different than the first vertical plane; and a carriage assembly configured to carry a toy vehicle across the gap such that the toy vehicle travels from the first gap end to the second gap end on the carriage assembly, the carriage assembly being moved from the first gap end to the second gap end by an assembly having an arm rotatable about an axis of rotation and having a carrying assembly at or near the end that receives the toy vehicle, wherein the carriage assembly rotates through an angle equal to or greater than 360 degrees as it carries the toy vehicle from the first gap end to the second gap end and wherein the carriage assembly includes a release mechanism, the release mechanism having a catch pivotally secured to the carriage assembly through a pin member about an axis wherein the release member being configured to engage the first gap end when the release mechanism is in a first position and release the release mechanism from the first gap end when the release mechanism is moved to a second position by the toy vehicle traveling onto the carriage assembly.

12. The toy track set of claim 11, wherein the first gap end is in a first horizontal plane and the second gap end is in second horizontal plane different than the first horizontal plane.

13. The toy track set of claim 11, wherein the carriage assembly rotates through an angle of about 540 degrees as it carries the toy vehicle from the first gap end to the second gap end.

14. The toy track set of claim 11, wherein the assembly includes:

a base;

a rotational housing supported by the base;

a rotational shaft surrounded by the rotational housing, rotatable about the axis of rotation and is coupled to the rotatable arm, the rotational shaft engaging the rotational housing to form a worm gear.

15. The toy track set claim 14, wherein the assembly further includes:

a tensioning mechanism biasing the rotational shaft in a first direction, said biasing causing the rotational shaft to rotate and to translate the toy vehicle from the first vertical plane to the second vertical plane as the rotational shaft rotates.

16. A toy track set, comprising:

a vehicle path defined by a track and a gap disposed between a first gap end and a second gap end; and a carriage assembly configured to carry a toy vehicle across the gap such that the toy vehicle travels from the first gap end to the second gap end on the carriage assembly, the carriage assembly being moved from the first gap end to the second gap end by an assembly having an arm rotatable about an axis of rotation, wherein the carriage assembly rotates through an angle equal to or greater than 360 degrees as it carries the toy vehicle from the first gap end to the second gap end, wherein the carriage assembly includes a release mechanism, the release mechanism being configured to engage the first gap end when the release mechanism is in a first position and release the release mechanism from the first gap end when the release mechanism is moved to a second position by the toy vehicle traveling onto the carriage assembly, wherein the release mechanism is configured to engage the second gap end when the release mechanism is in a third position.

* * * * *